US005184654A

United States Patent [19]

Benzing

[11] Patent Number: 5,184,654

[45] Date of Patent: Feb. 9, 1993

[54] VAPOR RECOVERY SEALING DEVICES

[75] Inventor: Bruce M. Benzing, Cincinnati, Ohio

[73] Assignee: Dover Corporation, New York, N.Y.

[21] Appl. No.: 716,935

[22] Filed: Jun. 18, 1991

[51] Int. Cl.[5] ..... B65B 1/28

[52] U.S. Cl. ..... 141/287; 141/44; 141/59; 141/93; 141/290; 141/387; 141/388; 137/615

[58] Field of Search ..... 141/93, 59, 44, 45, 141/287, 290, 285, 387, 388; 137/615

[56] References Cited

U.S. PATENT DOCUMENTS

| | | | |
|---|---|---|---|
| 2,763,419 | 9/1956 | Brown et al. | 141/290 |
| 2,832,378 | 4/1958 | Beavon | 141/287 |
| 3,825,045 | 7/1974 | Bloomquist | 141/387 X |
| 3,926,231 | 12/1975 | Madden et al. | 141/387 X |
| 4,180,272 | 12/1979 | Heitz | 141/287 X |
| 4,825,913 | 5/1989 | Stott | 141/59 |

FOREIGN PATENT DOCUMENTS

| | | | |
|---|---|---|---|
| 1497159 | 7/1989 | U.S.S.R. | 141/287 |
| 1287872 | 9/1972 | United Kingdom | 141/287 |
| 2053129 | 2/1981 | United Kingdom | 141/287 |

*Primary Examiner*—Ernest G. Cusick
*Attorney, Agent, or Firm*—Kinney & Schenk

[57] ABSTRACT

A sealing unit effects a connection between a loading boom and a manhole on a tank car. Liquids are delivered through the boom into the tank car. Vapors displaced from the tank are transmitted, through the sealing unit, to conduit means, which enable disposal of the vapors without contaminating the atmosphere. The unit comprises an upper plate which rests on the manhole. A sleeve is connected at its upper end to the upper plate and, at its lower end, to a lower plate. A pneumatic motor is actuated to draw the lower plate upwardly. When this occurs, the sleeve is bulged outwardly into sealing engagement with the manhole. Column springs are provided to assure that the central portion of the sleeve will bulge outwardly and provide sealing engagement with manholes of different diameters.

18 Claims, 11 Drawing Sheets

76
74
38
72
56 V
56
54
50
54 V
50V
67
62
45
32
66
52
52 V
70
F
70
68
48 V
M
48
34
46 V
4
4
82
60
68
40
70
70
66
67
64
44
42
36
46

VAPOR RECOVERY SEALING DEVICES

BACKGROUND OF THE INVENTION

The present invention relates to improvements in vapor recovery sealing devices employed in discharging liquids into a tank.

The sealing device of the present invention finds particular utility in preventing atmospheric contamination in filling large, bulk transport tanks such as are found on tanker trucks and railway tank cars for the transport of liquids such as fuel, acids, alkalis and other liquid chemical products. The vapors of such products are hazardous in various fashions when they escape into the atmosphere and become airborne.

This problem of atmospheric contamination is similar to the more widely recognized problem of pollution from gasoline vapors generated in filling vehicle fuel tanks. The latter problem has been adequately overcome by vapor recovery fuel nozzles. However, there are significant differences between filling a vehicle fuel tank and filling large, bulk tanks.

In bulk transport tanks, it is a widely accepted practice to discharge liquids through a large opening in the top of the tank. Conventionally the liquid is discharged into the tank by an articulated conduit system known as a loading boom. The conduits are large and of sufficient size to discharge liquids at rates of up to 50 to 100 gallons per minute or more.

There have been previous proposals for vapor recovery sealing devices adapted for use in filling such bulk transport tanks.

In one such device a plate overlays an upstanding flange, which commonly defines the manhole opening. J-hooks are then employed to engage the inner surface of the top of the tank to draw the plate into sealing engagement with the top of the flange. The device is mounted on the discharge end of a loading boom. One passage through the sealing plate permits discharge of liquid there through. Another passage provides for the flow of vapor from the tank to conduit means which extend to a remote location at which the vapors are condensed and/or otherwise safely disposed of.

Another prior proposal is similar in general function, but is provided with a conical member which sealingly engages an inner diameter surface defining the manhole opening.

These prior devices, while capable of fulfilling the basic vapor recovery function, have several shortcomings.

Primarily these shortcomings stem from the fact that there is a wide variation in the configuration of manholes from one bulk transfer tank to another.

The prior devices are limited in the range of variation in manhole configurations with which they can be used.

Another shortcoming of the prior devices is in the difficulties which can be encountered in obtaining an effective seal with the manhole opening.

SUMMARY OF THE INVENTION

The object of the present invention is to provide an improved vapor recovery sealing device and more specifically to overcome the shortcomings of prior vapor recovery sealing devices adapted for use in filling bulk transport tanks.

The foregoing ends may be attained by a vapor recovery sealing device which comprises a top plate and sleeve means depending therefrom. The top plate has a liquid passage and a vapor passage therethrough. The device may be inserted into a tank opening with the sleeve means registered with the inner diameter surface of the opening.

The sleeve means is characterized as a generally circular, thin walled tube. Means are provided for exerting an axial loading on the sleeve means. The sleeve means, when so loaded is further characterized by deflecting outwardly to form a circumferential seal with the inner diameter surface of the tank opening.

The top plate preferably has a vertical outline which extends outwardly of the sleeve means for engagement with a flange which further defines the tank opening. The sleeve means is thus registered with the inner diameter surface of the tank opening.

The means for exerting an axial loading on the sleeve means may comprise fluid motor means interconnecting on the top plate and the lower end of the sleeve means. Preferably the fluid motor means comprises a fluid motor mounted on the top plate and disposed coaxially of the sleeve means, with its piston rod connected to a plate which is secured to the lower end of the sleeve means.

The liquid passage may include an adapter projecting upwardly from the top plate for connection with a source of liquid to be discharged into the tank. The vapor passage may include a flange for connection with conduit means for disposal of vapors generated in filling tanks.

The sleeve means may comprise a plurality of vertical spring members defining an open work tube and an elastomeric sleeve. The elastomeric sleeve provides an impermeable membrane which extends from the top plate, at least, down to the circumferential seal formed with the inner diameter surface of the tank opening. Preferably the springs are of rectangular cross section and are curved outward to assure their outward deflection when subject to an axial loading.

Advantageously, the sleeve means further comprises top and bottom rings to which the spring members are attached. The ends of the elastomeric sleeve are then clamped to these rings.

Advantages are also found in the preferred use of twenty-four spring members having a given width.

An expansible band may be provided between the spring members and the elastomeric sleeve. This band spans adjacent spring members and supports the sleeve for firmer sealing engagement with the inner diameter surface of the tank opening.

Alternatively firmer sealing engagement may be had by providing a circumferential rib, projecting outwardly from the elastomeric sleeve at its point of engagement with the inner diameter surface of the tank opening.

Other features are found in the provision of means for sensing the sealing pressure of the sleeve means against the inner diameter surface of the tank opening. Control means for the fluid motor means are responsive to the sensing of a predetermined pressure to limit axial loading on the sleeve means. Preferably the pressure sensing means comprises a pressure transducer disposed between the elastomeric sleeve and one of the spring members.

Other features of the invention are found in the provision of a circumferential band between the elastomeric sleeve and the spring members to support the sleeve between adjacent springs and thus enhance sealing engagement with the inner diameter surface of the tank opening.

Also, the elastomeric sleeve may be provided with one or more circumferential, outwardly projecting ribs to enhance sealing engagement with the inner diameter surface of the tank opening.

In an alternate construction the sleeve means may comprise a thin walled synthetic resin tube, which is bowed outwardly, this tube may be provided with flanges permitting its direct attachment to the top plate and to a bottom plate.

The above and other related objects and features of the invention will be apparent from a reading of the following description of preferred embodiments with reference to the accompanying drawings and the novelty thereof pointed out in the appended claims.

DESCRIPTION OF THE PREFERRED EMBODIMENT

Figure 1:
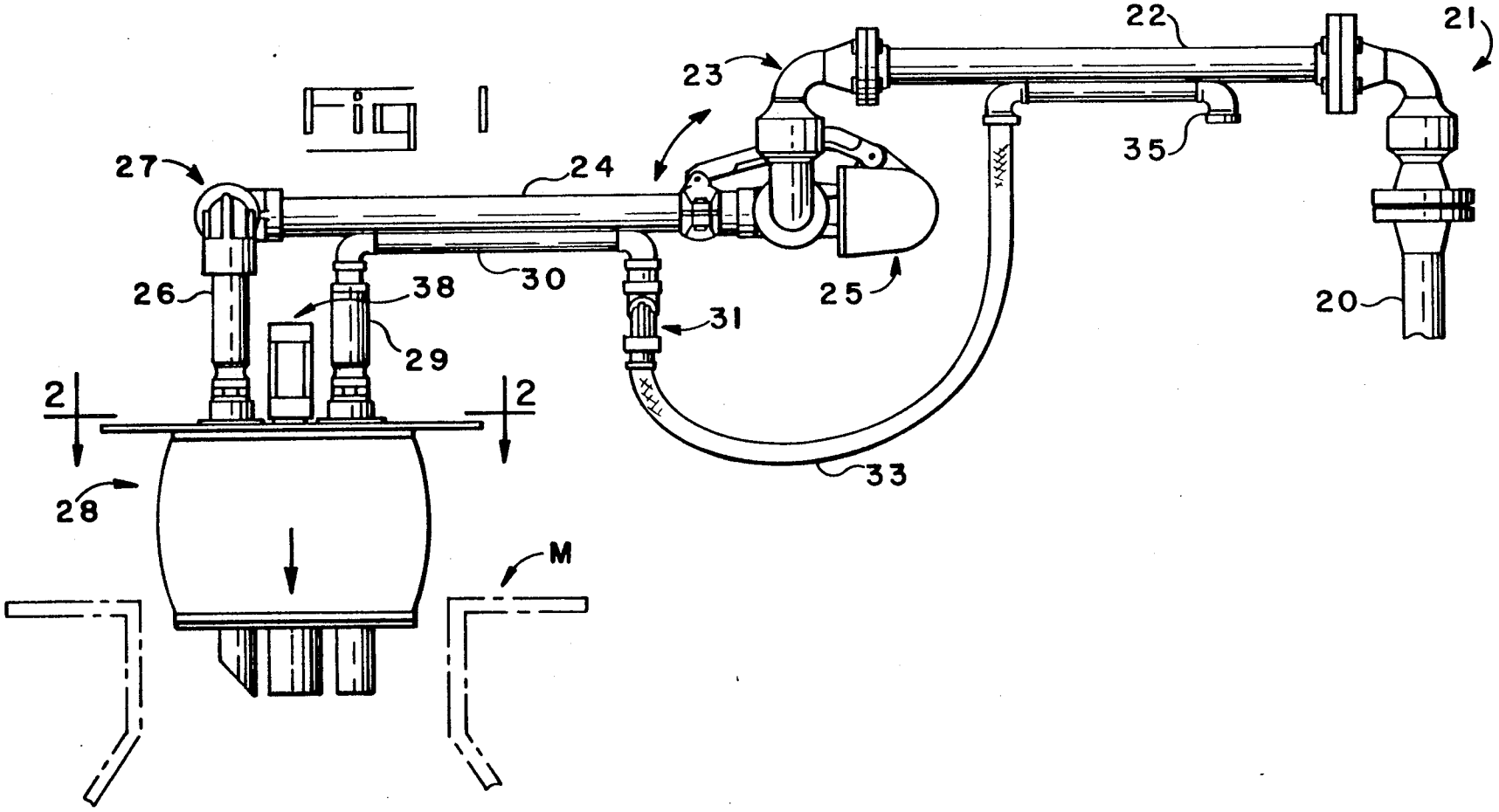
FIG. 1 is a simplified illustration of the tank sealing device of the present invention, mounted on a loading boom.
Figure 2:
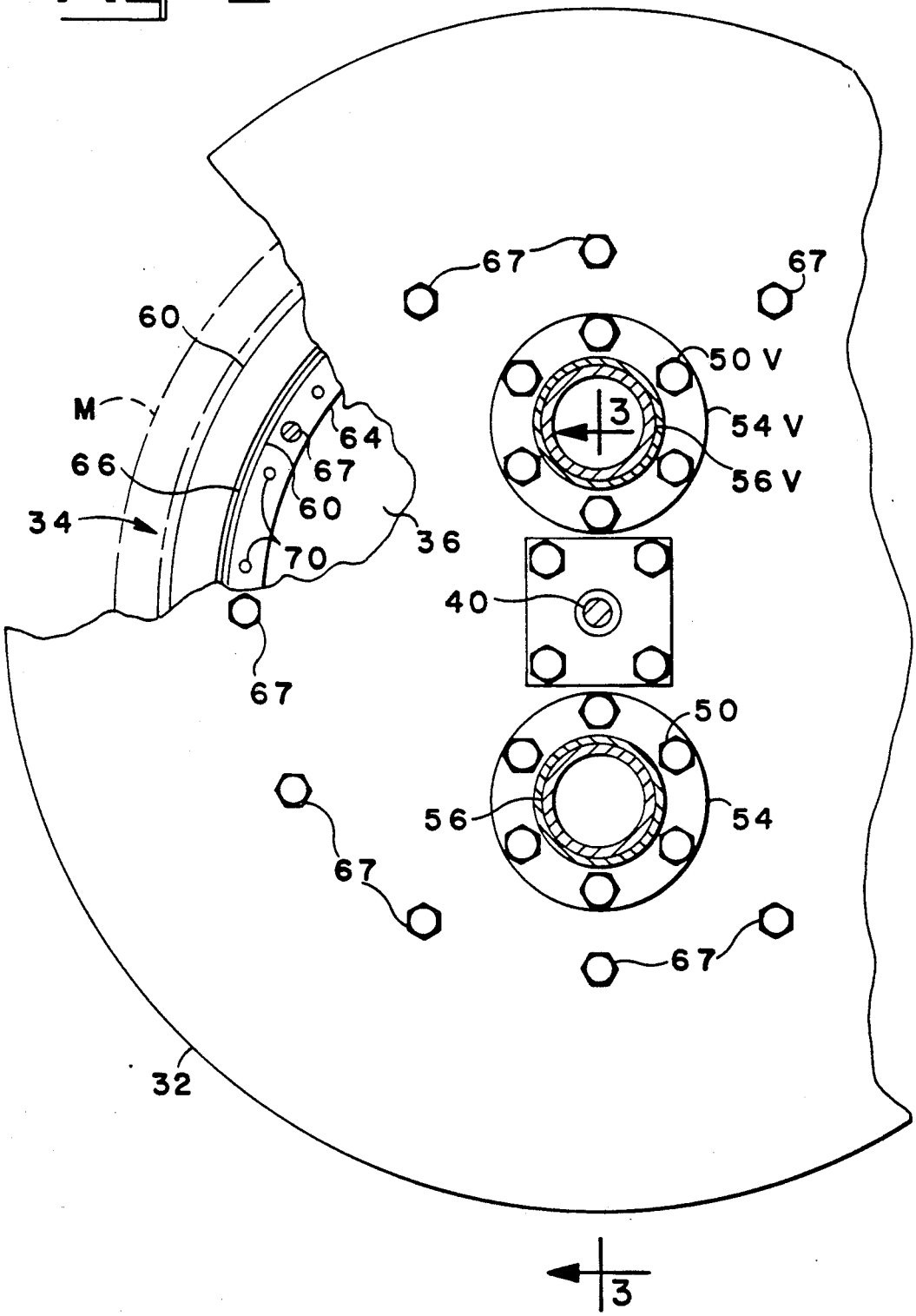
FIG. 2 is a section, taken generally on line 2—2 in FIG. 1, on an enlarged scale, looking down on the sealing device.

FIG. 1 is a simplified illustration of a boom loading system comprising a fixed conduit 20, which is connected to a pressurized, liquid fuel source. At this point, it will be noted that the present invention is applicable to the transfer or loading of a wide variety of liquids capable of releasing vapors which would contaminate the atmosphere. These liquids include both acids and alkalis, as well as petroleum, reference will be made to fuel as the liquid.

Boom loading systems can take many forms. The end objective is to enable the discharge portion thereof to be readily positioned relative to a tank car manhole, where the manhole position is a variable within a given range. For illustrative purposes, there is shown a first swivel 21, a horizontal conduit 22 a second swivel 23, a boom 24, which is provided with a spring counterbalance 25 for pivotal movement about a horizontal axis. A depending discharge conduit 26 is connected to the outer end of the boom 24 by a swivel 27.

The sealing device of the present invention indicated generally by reference character 28 is mounted on the lower end of the discharge conduit 26. The sealing device connects with a vapor return conduit system which comprises a vertical conduit 29, horizontal conduit 30, swivel 31, a loop of flexible conduit 33 and a connection 35 with a remote location at which vapors are safely disposed of.

In a loading operation the sealing device 28 would be manually registered with the manhole M of a tank and then lowered and sealed with respect thereto. Appropriate controls and valve means would then discharge fuel into the tank. When the filling operation is complete, the bottom plate is displaced downwardly to return the sleeve means to its insertion position and permit removal of the sealing device.

The sealing device 28 comprises a circular top plate 32, expansible sleeve means 34 and a bottom plate 36. A fluid motor 38 (hydraulic or pneumatic) is mounted on the top plate 32 with its piston rod 40 projecting therebeneath and connected by a conventional aligning coupler 42 to the bottom plate 36 through a threaded connection 44.

Figure 5:
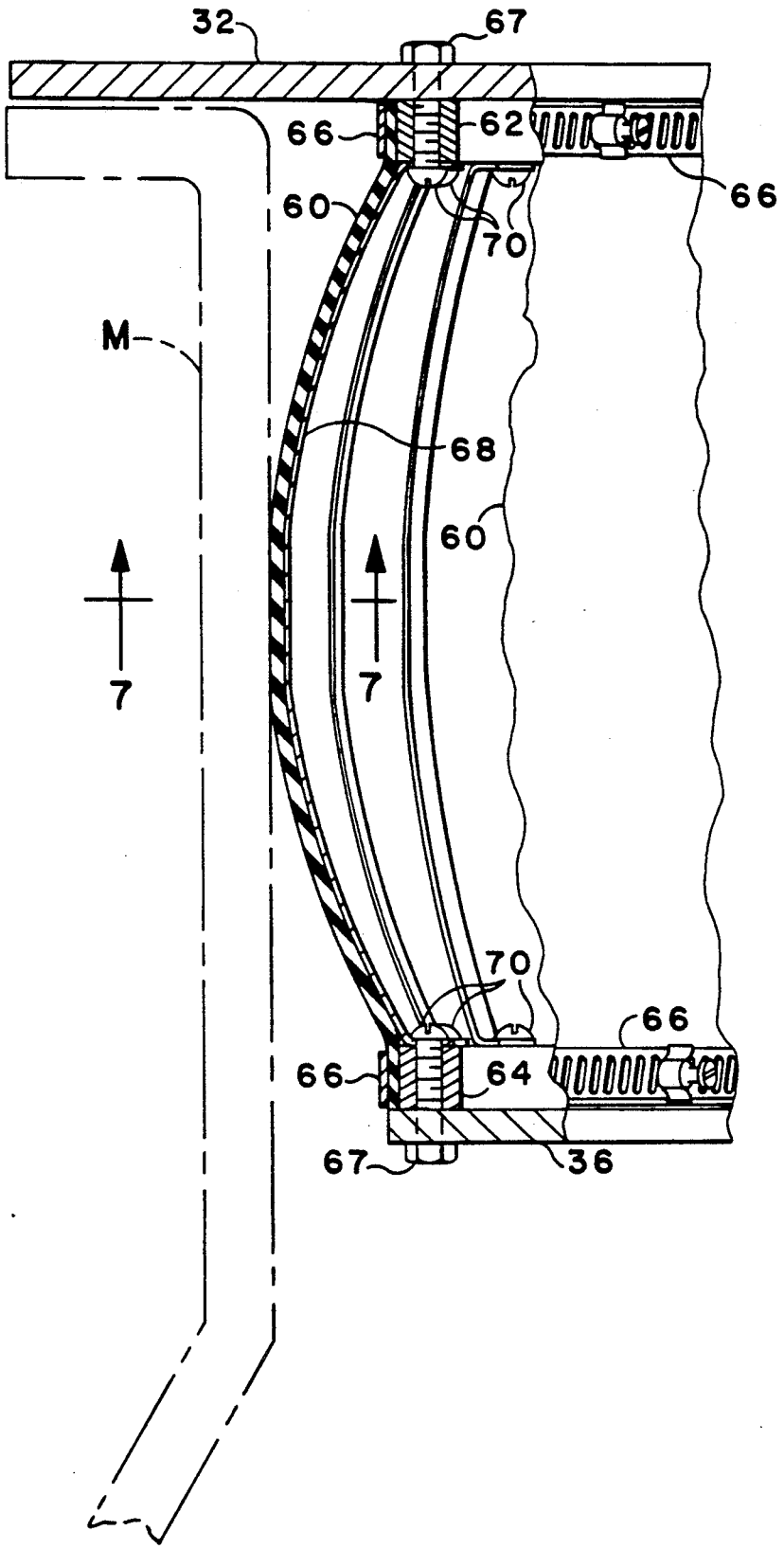
FIG. 5 is a fragmentary section, on an enlarged scale, taken on line 3—3 in FIG. 2, illustrating the sealing sleeve displaced into sealing engagement with a manhole.

This arrangement permits the bottom plate 36, to be displaced from an insertion position, upwardly towards the top plate 32 and a sealing position in which the sleeve means 34 sealingly engage the inner diameter (surface) of the manhole (FIG. 5).

A fuel passage 45 extends through the top plate 32 and conduit tube 46 is mounted on and depends from the top plate 32 by means of a flanged collar 48 and bolts 50/nuts 52 which clamp the flanged collar to the undersurface of the top plate 32. A second flanged collar 54 is mounted on the top upper surface of the top plate 32 by the bolts 52. A standard adapter 56 is mounted on the upper flanged collar. A fuel passageway is thus provided by way of the adapter 56, the flanged collar 54, a plate opening 45 the flanged collar 48 and tube 46 for discharge of fuel beneath the bottom plate 36. The connection of the fuel passageway means is thus sealed with respect to the top plate 32. The tube 46 passes through an opening in the bottom plate 36 to permit upward displacement thereof, as previously referenced. It is not necessary that there be a sealed connection between the tube 46 and bottom plate 36.

Vapor return passageway means are provided by corresponding structural elements mounted on the top plate 32 in diametrical alignment with the fuel passageway means, on the opposite side of the fluid motor 38. These elements are identified by the same reference characters as the fuel passageway elements, and with the addition of a "V" reference character.

The sleeve means 34 may be generally characterized as a thin walled tubular member which is subject to an axial or column loading, when the bottom plate 36 is drawn towards the top plate 32. It is further characterized in that, when subjected to a column loading, an intermediate portion is uniformly displaced for sealing engagement with the inner diameter of the manhole.

In a preferred form of the invention these ends are attained by an elastomeric sleeve 60 which is telescoped over top and bottom rings 62, 64 and secured thereto by clamps 66 of the type commonly used for radiator hoses. The top ring 62 is secured to the under surface of the top plate 32 and the bottom ring 64 is secured to the upper surface of the bottom plate 36 by screw 67.

Figure 3:
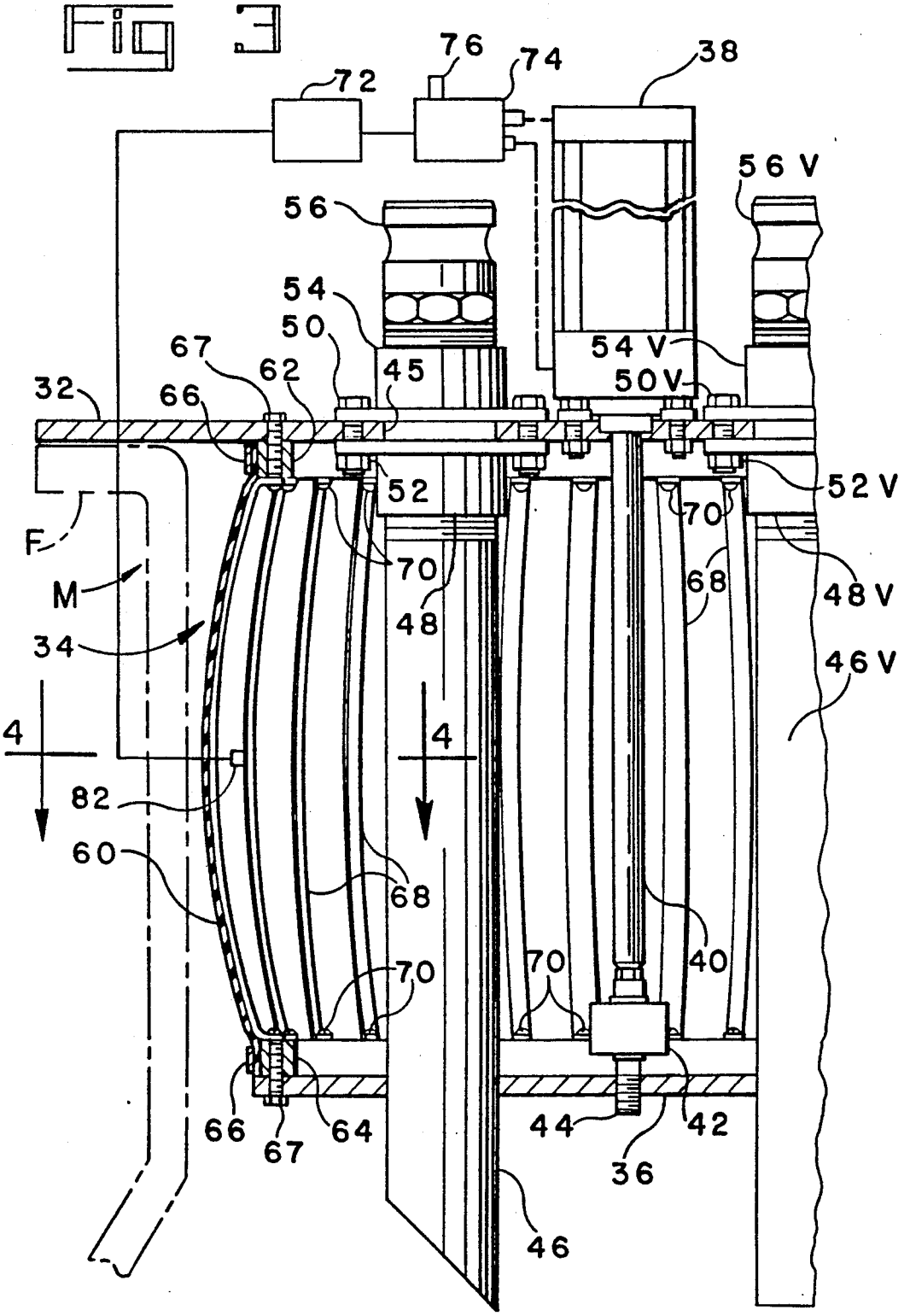
FIG. 3 is a section taken on line 3—3 in FIG. 2.
Figure 4:
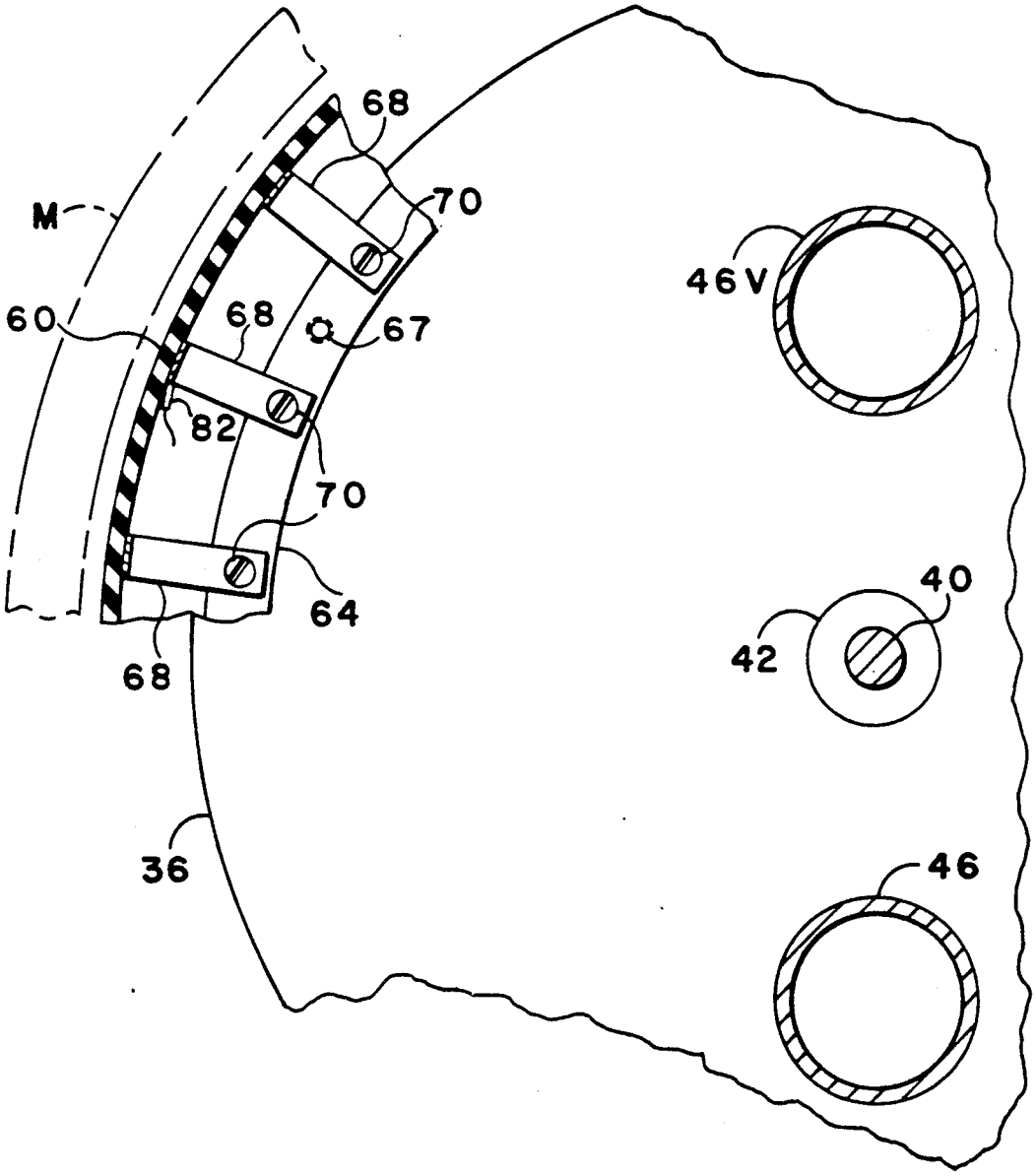
FIG. 4 is a section taken on line 4—4 in FIG. 3.

The sleeve means 34 further comprises a plurality of column, springs 68, which have unbent tabs respectively secured to opposed surfaces of the top and bottom rings 62, 64 by screws 70. The elastomeric sleeve 60 may be formed with a uniform, initial formed with an outward curvature as indicated. In assembling the sleeve means, the elastomeric sleeve may be first mounted on the rings 62, 64. The column springs 68 may be mounted on the top and bottom rings 62, 64. In so doing there is a preliminary expansion of the elastomeric sleeve 60 by the springs 68, as indicated in FIG. 3. This is the rest, or insertion portion of the sealing sleeve means 34.

The sealing sleeve means 34 is in this insertion position when the sealing device 28 is initionally positioned with respect to a manhole M for loading fuel. This relationship is indicated in FIG. 3, where it will be seen that the top plate 32 rests on and is positioned by the top of the flange F, which defines the manhole M. The inner surface, or inner diameter of the manhole is circular and has a diameter greater than the outer diameter of the sealing means 34.

Appropriate control means 72 are provided for a valve 74, which is connected at 76 to a pressurized fluid source. The valve 76 has outlet connections for selectively directing pressurized fluid to opposite ends of the fluid motor 38. Upon actuation of the control means 72, the piston rod 40 is retracted, drawing the bottom plate 36 upwardly and exerting an axial or a column loading on the sleeve means 34. This column loading causes an increase in the diameter of the central portion of the sleeve means 34 and creates a circumferential seal between the elastomeric sleeve 60 and the inner diameter of the manhole, FIG. 5.

A pressure transducer 82 is provided on the sleeve means and is responsive to the pressure with which the sleeve means engages the inner diameter of the manhole. When a predetermined pressure is reached, the transducer 82 provides an input signal to the control means 72. This, in turn, results in the valve means 76 controlling fluid flow to the air motor 38 so that the piston rod 40 is maintained in a position in which a proper seal is obtained with the manhole.

The described operation enables the present device to be used with manholes having a relatively wide range of internal diameters. This is to say that, by limiting movement of the bottom plate, as described, an effective seal is obtained, without overstressing the sealing sleeve means components.

The valve means 74 and control means 72 may comprise commercially available components, which may be readily selected and interconnected by one skilled in the art to attain the described ends. Such components may be mounted on the sealing device or remotely, as would be permitted by flexible hoses and electrical conductors.

Figure 6:
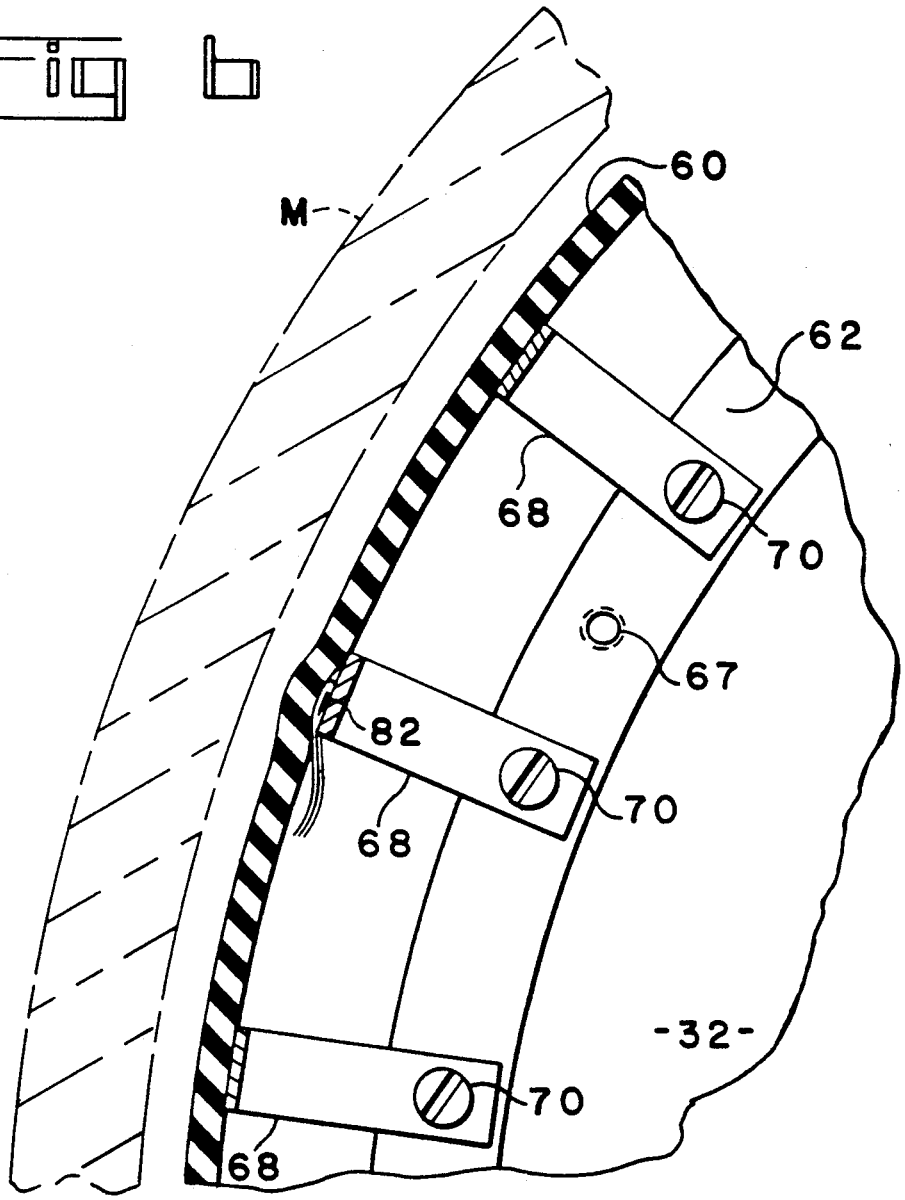
FIG. 6 is a section, on an enlarged scale, also taken on line 4—4 in FIG. 3.

The transducer 82 is likewise a commercial available component. Mounting of the transducer 82 is diagrammatically shown in FIG. 3. FIG. 6 illustrates preferred means for mounting this transducer, namely by attaching it to the outer surface of one of the springs 68, as by adhesive means. The transducer 82 is disposed intermediate the height of the spring 68 and preferably intermediate its width. The transducer thus reflects the pressure exerted between the spring 68 and elastomeric sleeve 60. When the spring 68 is deflected outwardly and the sleeve 60 engages the manhole inner diameter, the pressure of the sleeve 60 against the inner diameter is reflected by the pressure of the spring 68 against the sleeve 60, for the proper control of movement of piston rod 40.

The relationship involved in expanding the central portion of the sleeve means 34 to its sealing portion will now be discussed in further detail.

It is well known that a rod, or other elongated member, will deflect laterally rather than failing in compression, when subject to an axial, or column loading. In the described embodiment, the springs 68 function as columns and compositely form an openwork tube. They are purposely curved so that when subject to a column loading (when the lower plate 36 is drawn upward) they will deflect radially outwardly to increase the diameter of the sealing means.

The elastomeric sleeve 60 functions to provide an expansible, impermeable membrane, covering the openwork tube formed by the springs 68, i.e., the spaces between adjacent springs.

The springs 68 are formed of spring steel and the elastomeric sleeve may be formed of neoprene, natural rubber, or other elastomers depending on the properties of the fuel or other liquid to be handled.

To exemplify a suitable sleeve means, the following is pertinent.

The sleeve 60 had an undeflected inner diameter of 15.75 (at its upper lower ends) and a wall thickness of 0.125 inches. The material employed was a poly-chloroprene, neoprene; ASTM-D Classification: BL-B5; durometer 60 (Shore A); Tensile strength 1,000 psi; and an elongation if 350%.

The spring 68 were made of 0.030 spring steel and has a wideth of 0.5 inch. The springs had a height of 11.52 inches and were bowed outwardly on a radius of 17.059 inch.

Twenty four springs were employed.

The sealing sleeve means thus constructed was found effective in providing an adequate seal with manholes having an inner surface diameter ranging from 16 to 21 inches.

Figure 7:
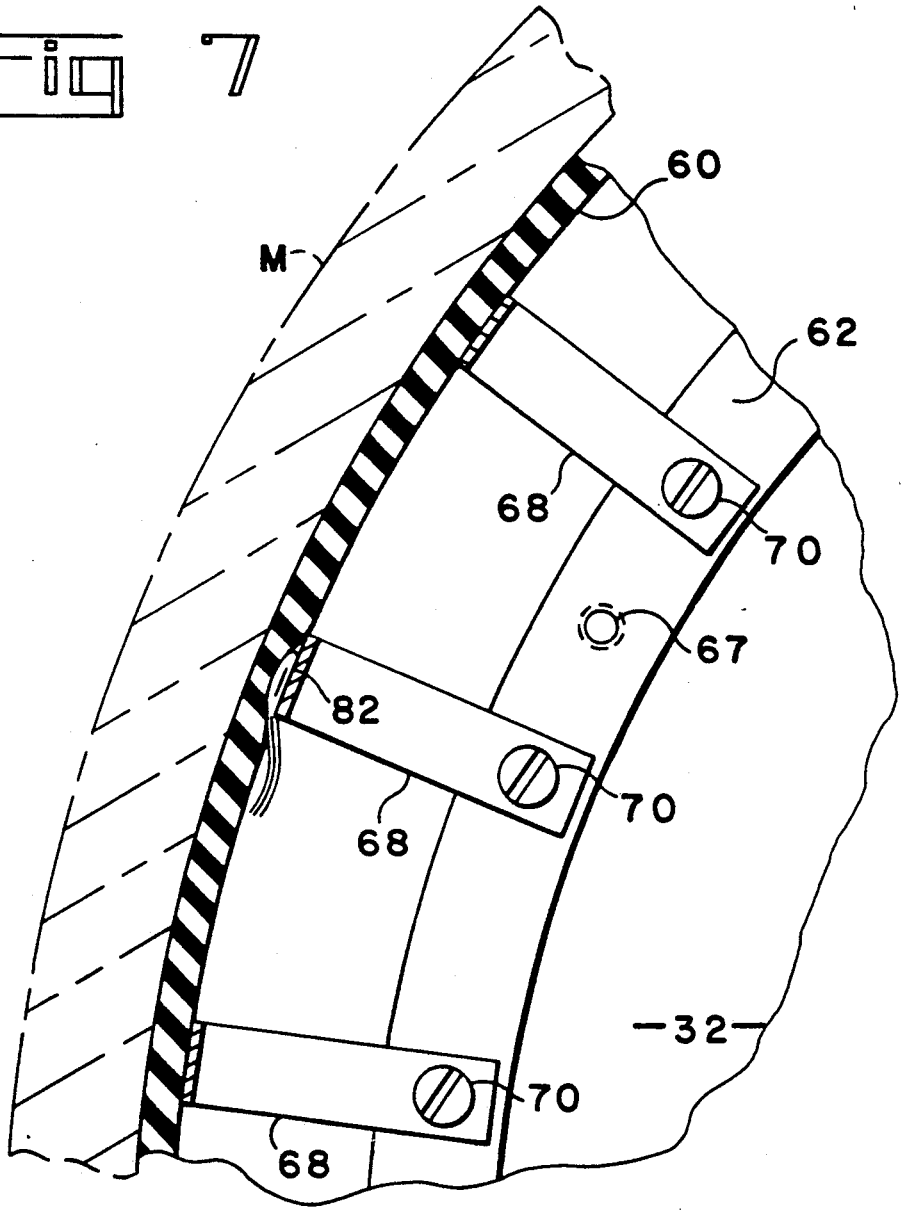
FIG. 7 is a section, on the same scale as FIG. 6 taken on line 7—7 in FIG. 5.

Reference is made to FIG. 7, which illustrates that the lateral distance between adjacent springs 68 increases in the sealing portion of the sealing sleeve means. Thus there is a greater span of the sleeve 60 which tends to follow a cord between adjacent springs 68 and thus a reduced sealing pressure against the manhole inner diameter surface.

As indicated above the preferred use of twenty four springs 68 and the described sleeve 60 has been found effective in providing a seal with a wide range of manhole diameters. This end is further facilitated by a preferred relation of the sleeve 60 being free to expand relative to the springs 68, i.e., the sleeve is not bonded to the springs.

Higher sealing pressures could be obtained by increasing the number of springs 68, but it has been found that such increase becomes uneconomical, in light of alternate means now to be described.

Figure 8:
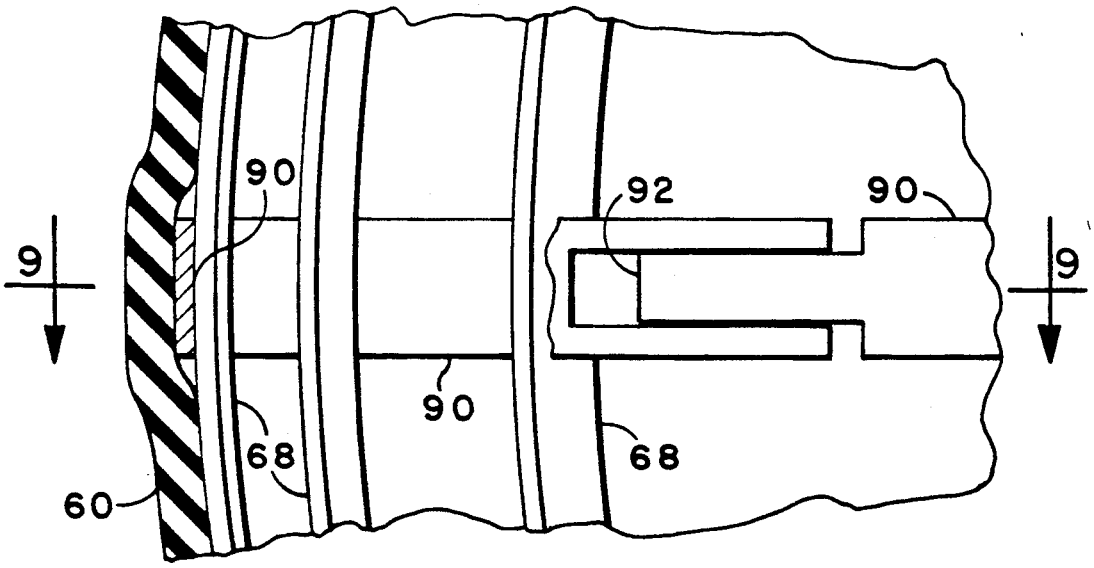
FIG. 8 is a fragmentary longitudinal section through a modified sleeve means.
Figure 9:
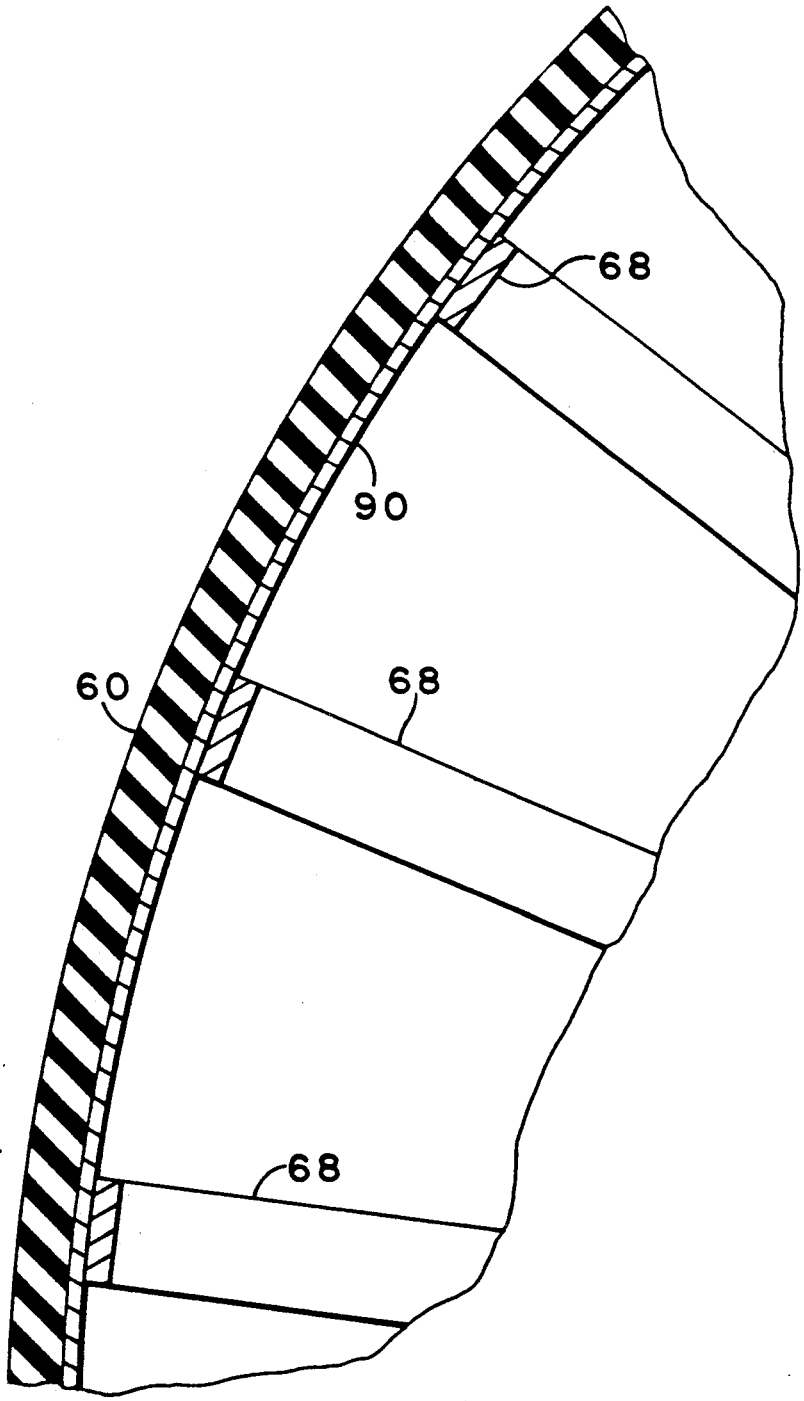
FIG. 9 is a section taken on line 9—9 in FIG. 8.

FIGS. 8 and 9 illustrate the provision of a circumferential, supporting band 90 disposed between the sleeve 60 and the springs 68 intermediate the height of the springs. The ends of the band are interdigitated, as shown at 92 to permit the band 90 to expand with the sleeve means when it is subject to an axial loading.

The band 90 which may be of a thin spring steel stock, spans adjacent springs 68 and provides support for the elastomeric sleeve 60 to assure sealing engagement with the inner diameter surface of the manhole opening.

Figure 10:
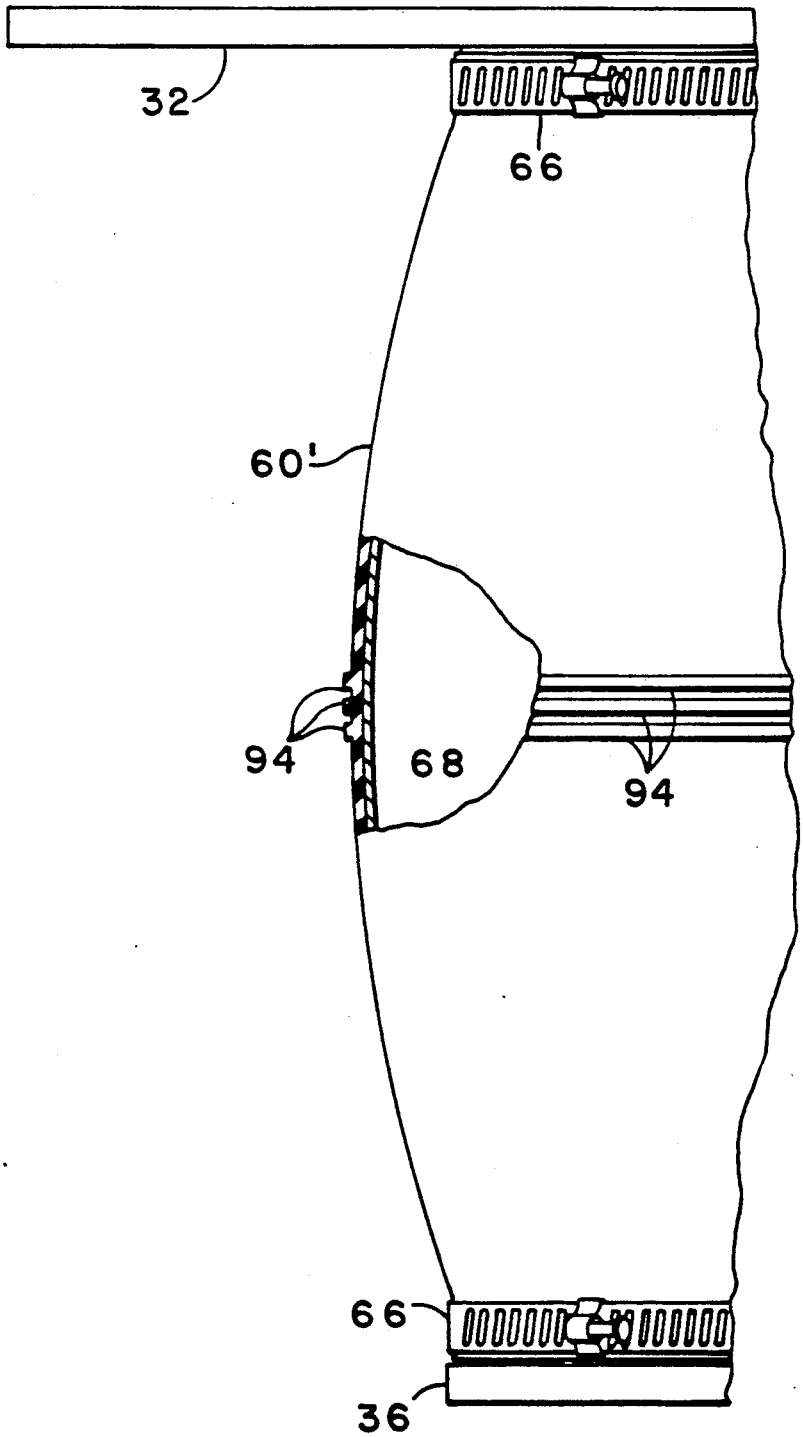
FIG. 10 is a fragmentary elevation, partially in section of another modified sleeve means.

FIG. 10 illustrates an alternate means for assuring sealing engagement. This means takes the form of outwardly projecting ribs 94 formed circumferentially of an elastomeric sleeve 60. These ribs are also effective in assuring sealing engagement in the portions of the sleeve not supported by springs 68.

Figure 11:
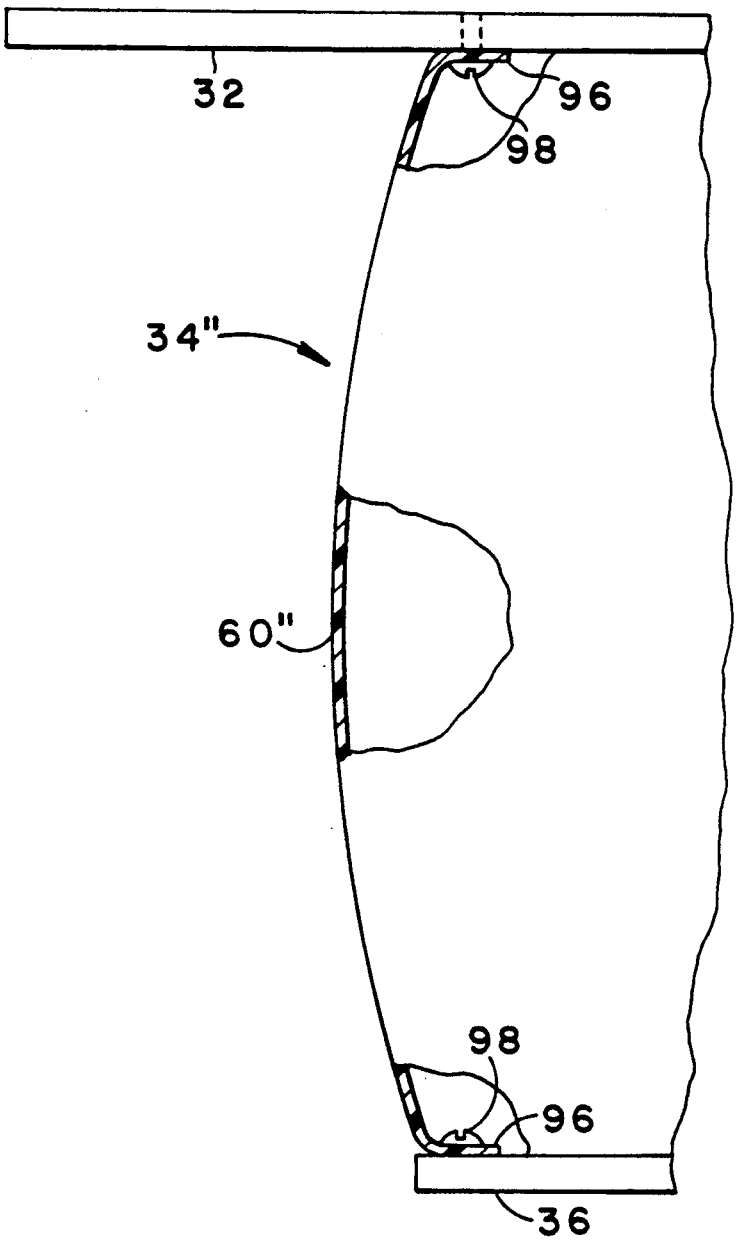
FIG. 11 is a fragmentary elevation, partially in section, of a further, modified sleeve means.

FIG. 11 illustrates a modified form of sleeve, means 34" which comprises a thin walled synthetic; resinous sleeve 60" which is curved outwardly. This sleeve has integral inturned flanges 96, at its upper and lower ends to permit its direct attachment to the top plate 32 and bottom plate 36, as by screws 98.

The resinous material of the sleeve 60" will be selected to permit its repeated deflection to and from a sealing portion. The durometer of this material would be higher than that of the sleeve 60. Therefore, it could be advantageous to coat the outer surface with an elastomeric material having a lower durometer.

It will be appreciated that in the described embodiments, the manhole opening is effectively sealed, excepting for the fuel passage means which permit discharge of fuel into the tank and except for the vapor passage means which permit for the controlled recovery of vapors.

Additional components, such as level sensors can be mounted on the device and extend through the top plate 32, so long as this sealed relation is maintained.

The above and other modifications of the embodiments disclosed will occur to those skilled in the art within the spirit of the scope of the present invention as defined in the following claims.

Having described the invention what is claimed as new and desired to be secured by Letters Patent of the United States is:

1. A vapor recovery sealing device for use in discharging liquid into a tank through an opening defined by an inner diameter, said device comprising a top plate having a liquid inlet passage and a vapor outlet passage, sleeve means depending from said top plate and having its upper end sealingly connected thereto, and means for exerting an axial, compressive loading on said sleeve means to bring it to a sealing position, said sleeve means being characterized in that it is a thin walled tube generally circular in cross section and the walled tube deflects outwardly to sealingly engage the inner diameter of the tank opening, in response to a compressive axial loading thereon, whereby the outer surface of the sleeve means circumferentially engages the inner diameter of the tank opening to form a circumferential seal therewith.

2. A sealing device as in claim 1 which is adapted for use with a tank opening which is further defined by an upstanding flange and further wherein the top plate has a vertical outline of greater lateral extent than that of sleeve means and is engageable with said flange to position the sleeve means with respect to the inner diameter of the tank means.

3. A sealing device as in claim 2 wherein the means for exerting an axial loading comprise fluid motor means interconnecting the top plate and the lower end of the sleeve means.

4. A sealing device as in claim 3 further comprising a bottom plate secured to the lower end of the sleeve means, and wherein the fluid motor means comprise a fluid motor mounted on the top plate and coaxially of the sleeve means and having a piston rod connected to the bottom plate.

5. A sealing device as in claim 4 wherein the liquid and vapor passages are diametrically aligned and disposed on opposite sides of the fluid motor.

6. A sealing device as in claim 5 wherein the liquid passage and the vapor passage each comprises an adapter projecting upwardly from the top plate and providing means for mounting the sealing device on a loading boom by connection to couplings on boom conduits for liquids and vapors and the liquid passage and the vapor passage each also comprises a tube depending from the top plate and extending through the bottom plate.

7. A sealing device as in claim 3 wherein the liquid passage comprises an adapter projecting upwardly from the top plate and providing means for mounting the sealing device on a loading boom by connection to a liquid conduit coupling on the loading boom.

8. A sealing device as in claim 1 wherein the sleeve means comprises a plurality of vertical spring members defining an openwork tube, and an elastomeric sleeve telescoped over said spring members and providing an impermeable membrane between, at least, the top plate and the circumferential seal obtained by outward deflection of the sleeve means.

9. A sealing device as in claim 8 wherein each of said spring members has a rectangular cross section and is precurved outwardly.

10. A sealing device as in claim 9 wherein the sleeve means consists of twenty-four spring members and the spring members and sleeve are proportioned to the following relationships of:

an inner sleeve diameter of 15.75 inches at the upper and lower ends of the sleeve a sleeve wall thickness of 0.125 inches a spring member cross section of 0.030 inches by 0.5 inches a spring member height of 11 inches and a spring member curvature radius of 17 inches.

11. A sealing device as in claim 9 wherein the sleeve means further comprises upper and lower rings over which the ends of the elastomeric sleeve extend, band clamps securing the sleeve ends to the upper and lower rings, and the spring members have Vinbent tabs secured to radial surfaces of said rings, and further comprising means securing the top ring to the top plate.

12. A sealing device as in claim 9 wherein the sleeve means further comprises a circumferential, expandable band, having a rectangular cross section spanning adjacent spring members, said band being disposed midway between the upper and lower ends of the elastomeric sleeve and between the elastomeric sleeve and the spring members, thereby supporting the elastomeric sleeve for circumferential sealing engagement with the tank opening inner diameter.

13. A sealing device as in claim 8 wherein said elastomeric sleeve has, on its outer surface, at least one, circumferential, outwardly projecting rib for sealing engagement with the inner diameter of the tank opening.

14. A sealing device as in claim 3 further comprising control means for the fluid motor means and means for sensing the sealing pressure between the sleeve means and the inner diameter of the tank opening, when fluid motor means exerts an axial loading on the sleeve means said control means being responsive to said pressure sensing means to limit movement of the fluid motor means when a predetermined sealing pressure is reached.

15. A sealing device as in claim 4 wherein the sleeve means comprises a plurality of vertical spring members defining an open work tube, and an elastomeric sleeve telescoped over said spring members and providing an impermeable membrane between, at least, the top plate and the circumferential seal obtained by outward deflection of the sleeve means, and further comprising control means for the fluid motor and means for sensing the pressure between the elastomeric sleeve and one of the spring members to thereby obtain an indication of the sealing pressure between the elastomeric sleeve and the inner diameter of the tank opening, said control means being responsive to said pressure sensing means to limit movement of the fluid motor when a predetermined pressure is sensed.

16. A sealing device as in claim 15 wherein the spring members have a rectangular cross section and are precurved outwardly, and the pressure sensing means comprises a pressure transducer disposed, at the point of maximum curvature, between a spring member and the elastomeric sleeve.

17. A sealing device as in claim 1 wherein the sleeve means is a resilient tube curved outwardly.

18. A sealing device as in claim 17 wherein the resilient tube is provided with an integral, inturned flange at its upper end, which flange is secured to the lower surface of the top plate.

* * * * *